US011754059B2

(12) United States Patent
Andersen et al.

(10) Patent No.: US 11,754,059 B2
(45) **Date of Patent: *Sep. 12, 2023**

(54) PISTON OF A HYDRAULIC MACHINE AND HYDRAULIC PISTON MACHINE

(71) Applicant: Danfoss A/S, Nordborg (DK)

(72) Inventors: Stig Kildegaard Andersen, Krusaa (DK); Frank Holm Iversen, Padborg (DK); Sveinn Porarinsson, Reykjavik (IS)

(73) Assignee: Danfoss A/S, Nordborg (DK)

( * ) Notice: Subject to any disclaimer, the term of this patent is extended or adjusted under 35 U.S.C. 154(b) by 385 days.

This patent is subject to a terminal disclaimer.

(21) Appl. No.: 17/038,818

(22) Filed: Sep. 30, 2020

(65) Prior Publication Data

US 2021/0148342 A1 May 20, 2021

(30) Foreign Application Priority Data

Nov. 15, 2019 (DE) ..... 102019130843.7

(51) Int. Cl.
*F04B 1/124* (2020.01)
*F04B 1/2078* (2020.01)

(52) U.S. Cl.
CPC ..... *F04B 1/124* (2013.01); *F04B 1/2078* (2013.01)

(58) Field of Classification Search
CPC .... F03C 1/0406; F03C 1/0605; F04B 1/0408; F04B 1/124; F04B 27/0409; F04B 27/0878; F04B 39/0011; F04B 53/14; F04B 53/22; F15B 15/1447; F16J 1/005; F16J 1/006
See application file for complete search history.

(56) References Cited

U.S. PATENT DOCUMENTS 2,861,278 A * 11/1958 Young ..... A47C 19/027 5/659
2,998,288 A * 8/1961 Newhouse ..... F16J 1/006 92/182
3,113,491 A * 12/1963 Borowka ..... F04B 53/14 92/158
3,187,644 A 6/1965 Ricketts
3,633,467 A 1/1972 Watanabe
3,741,077 A 6/1973 Hulsebus et al.
(Continued)

FOREIGN PATENT DOCUMENTS

CN 1294036 A 5/2001
CN 1316600 A 10/2001
(Continued)

OTHER PUBLICATIONS

First Examination Report for Indian Patent Application No. 202014036982 dated Dec. 14, 2021.
(Continued)

*Primary Examiner* — Kenneth Bomberg
*Assistant Examiner* — Matthew Wiblin
(74) *Attorney, Agent, or Firm* — McCormick, Paulding & Huber PLLC

(57) ABSTRACT

A piston (1) of a hydraulic piston machine is described, the piston (1) having a hollow (2) surrounded by a wall (3) and an insert (4) arranged in the hollow (2). Such a piston is used to have a piston machine with high efficiency at low costs. To this end at least two pliable rings (12, 13) are arranged between the insert (4) and the wall (3).

16 Claims, 1 Drawing Sheet

(56) References Cited

U.S. PATENT DOCUMENTS

| | | | | |
|---|---|---|---|---|
| 3,747,479 | A | 7/1973 | Nightingale et al. | |
| 3,828,654 | A | 8/1974 | Wiethoff | |
| 3,861,278 | A | 1/1975 | Forster | |
| 3,915,071 | A | 10/1975 | Forster | |
| 3,986,439 | A | 10/1976 | Ring | |
| 3,999,468 | A | 12/1976 | Bristow et al. | |
| 4,009,645 | A | 3/1977 | Freimuth | |
| 4,191,095 | A | 3/1980 | Heyl | |
| 4,481,867 | A | 11/1984 | Nagase et al. | |
| 5,007,332 | A * | 4/1991 | Wagenseil | F04B 1/124 92/255 |
| 5,072,655 | A | 12/1991 | Adler | |
| 5,080,202 | A | 1/1992 | Tristano et al. | |
| 5,216,943 | A * | 6/1993 | Adler | B22D 19/0027 29/888.047 |
| 5,265,331 | A | 11/1993 | Engel et al. | |
| 5,564,903 | A | 10/1996 | Eccles et al. | |
| 5,730,043 | A | 3/1998 | Kristensen et al. | |
| 6,120,265 | A * | 9/2000 | Wu | F04B 33/005 417/526 |
| 6,250,206 | B1 | 6/2001 | Johnson | |
| 6,293,185 | B1 | 9/2001 | Stoppek et al. | |
| 6,318,241 | B1 | 11/2001 | Stoppek et al. | |
| 6,325,181 | B1 | 12/2001 | Di Ponio | |
| 2016/0273653 | A1* | 9/2016 | Tamashima | F04B 53/08 |
| 2021/0148343 | A1* | 5/2021 | Andersen | F04B 1/2021 |
| 2022/0010786 | A1 | 1/2022 | Koide et al. | |

FOREIGN PATENT DOCUMENTS

| | | | | |
|---|---|---|---|---|
| CN | 102086852 | A | 6/2011 | |
| CN | 108105048 | A | 6/2018 | |
| CN | 210564920 | U | 5/2020 | |
| DE | 1 033 028 | B | 6/1958 | |
| DE | 7108800 | U | 7/1971 | |
| DE | 2363941 | A1 | 6/1974 | |
| DE | 2548702 | A1 | 5/1977 | |
| DE | 3732648 | A1 | 4/1989 | |
| DE | 69507576 | T2 | 7/1999 | |
| ES | 2 826 125 | A1 | 5/2021 | |
| GB | 1127291 | A | 9/1968 | |
| GB | 1332183 | A | 10/1973 | |
| GB | 1403830 | | 8/1975 | |
| JP | 2001289170 | A | 10/2001 | |
| JP | 2001289179 | A | 10/2001 | |
| WO | 2020/101027 | A1 | 5/2020 | |
| WO | WO-2020114529 | A1 * | 6/2020 | F02M 37/16 |

OTHER PUBLICATIONS

Search Report for Great Britain Patent Application No. GB2017764.8 dated Apr. 7, 2021.

Search Report for Great Britain Patent Application No. GB2017765.5 dated Apr. 7, 2021.

Examination Report under Section 18(3) for Great Britain Patent Application No. GB2017765.5, dated May 2, 2023.

* cited by examiner

PISTON OF A HYDRAULIC MACHINE AND HYDRAULIC PISTON MACHINE

CROSS-REFERENCE TO RELATED APPLICATION

This application claims foreign priority benefits under 35 U.S.C. § 119 to German Patent Application No. 102019130843.7 filed on Nov. 15, 2019, the content of which is hereby incorporated by reference in its entirety.

TECHNICAL FIELD

The present invention relates to a piston of a hydraulic piston machine, the piston having a hollow surrounded by a wall and an insert arranged in the hollow.

BACKGROUND

Furthermore, the invention relates to a hydraulic piston machine.

A piston machine is a machine with positive displacement and can be, for example, in the form of an axial piston machine.

Such a machine is used, for example, for pumping a liquid like water. Although water is generally considered as an incompressible fluid, it is in fact slightly compressible. The compressibility of water decreases the efficiency of the machine.

In order to reduce the negative effects of the compressibility of the liquid, the insert is used to reduce loss of capacity due to fluid filled dead volume. This increases energy efficiency and enables the machine to operate at higher pressures and speeds.

However, it is difficult to fix the insert reliably in the hollow of the piston. It is known to use an insert of a polymer material which is pressed into the hollow. However, such a mounting step bears the risk of a deformation of the piston. Thus, it is necessary to produce the insert with high accuracy to obtain small tolerances. This increases the costs of the hydraulic piston machine.

SUMMARY

The object underlying the invention is to have a piston machine with high efficiency at low costs.

This object is solved with a piston as described at the outset in that at least two pliable rings are arranged between the insert and the wall.

The pliable rings can be deformed during the insertion of the insert into the hollow. After insertion of the insert into the hollow the pliable rings secure the insert in the piston thereby defining a position of the insert in the hollow which can be maintained even against forces which can be produced by centrifugal forces during higher working speeds of the piston. Such centrifugal forces can occur, for example, when the piston is arranged in a cylinder drum of an axial piston machine.

In an embodiment of the invention the two rings are located on both sides of a center of mass of the insert. The two pliable rings prevent a tilting of the insert in the hollow and accordingly prevent a wear of the insert.

In an embodiment of the invention a first ring secures an axial position of the insert in the piston and a second ring secures a radial position of the insert in the hollow only. Thus, an overdetermination of the position is avoided.

In an embodiment of the invention the first ring is located adjacent an open end of the hollow. This facilitates the mounting of the insert in the hollow. The first ring has to be moved only for a small distance into the hollow.

In an embodiment of the invention the first ring is arranged in an inner groove in the wall and in an outer groove in the insert. The first ring locks the insert in the hollow.

In an embodiment of the invention the second ring rests against a bottom of the hollow. The bottom forms an end stop for the movement of the second ring. Thus, the position of the second ring is reliably determined.

In an embodiment of the invention the insert comprises a conical section near an end remote from the open end of the hollow and the second pliable ring is arranged around a conical section. Thus, the insert can be centered with respect to the second ring and thus can be centered with respect to the axis of the piston.

In an embodiment of the invention a gap is formed between the insert and the wall. The gap has two advantages. It prevents a contact between the insert and the wall of the hollow and prevents accordingly a wear of the insert or wall which could result from a movement of the insert in relation to the wall. Furthermore, the gap allows a flow of fluid along the wall of the piston which can be used for cooling the piston.

In an embodiment of the invention at least the first ring comprises at least one thin section having a radial extent smaller than the largest radial extent of the ring. The thin section allows liquid to pass the first ring and to enter the gap. When the second ring comprises also a thin section, fluid is allowed to pass the second ring.

In an embodiment of the invention the ring comprises a number of blocks separated by thin sections. The ring is formed by a succession of blocks and thin sections. Thus, there are provided a number of fluid passages passing the first ring.

In an embodiment of the invention the blocks are spaced equidistantly. When the blocks are distributed evenly around the circumference of the insert they ensure even distribution of the fluid flow in the gap between the insert and the piston and minimize the form defects in the roundness of the piston caused by pressing the insert into the hollow. The ring ensures that the insert is accurately centred inside the piston.

In an embodiment of the invention the thin sections have an axial extension smaller than the axial extension of the blocks. The thin sections form a sort of spring allowing the deformation of the ring when the insert is inserted into the hollow. Furthermore, they increase a section of a flow path past the ring, in particular at the second ring, when it rests against the bottom of the hollow.

In an embodiment of the invention the first ring and the second ring have the same form. This facilitates assembly of the piston and the insert. It is not necessary to take care about the form of the ring in the respective position at both ends of the insert.

In an embodiment of the invention the insert is of a ceramic material or of fibre reinforced plastics. A ceramic material can be produced with a low mass and with almost no compressibility. The same is true for fibre reinforced plastic material, in particular fibre reinforced polymer, like PEEK (Polyetheretherketone).

BRIEF DESCRIPTION OF THE DRAWINGS

The invention relates to a hydraulic piston machine having a piston as described above.

The invention will now be described in more detail with reference to the drawing, wherein.

DETAILED DESCRIPTION

Figure 1:
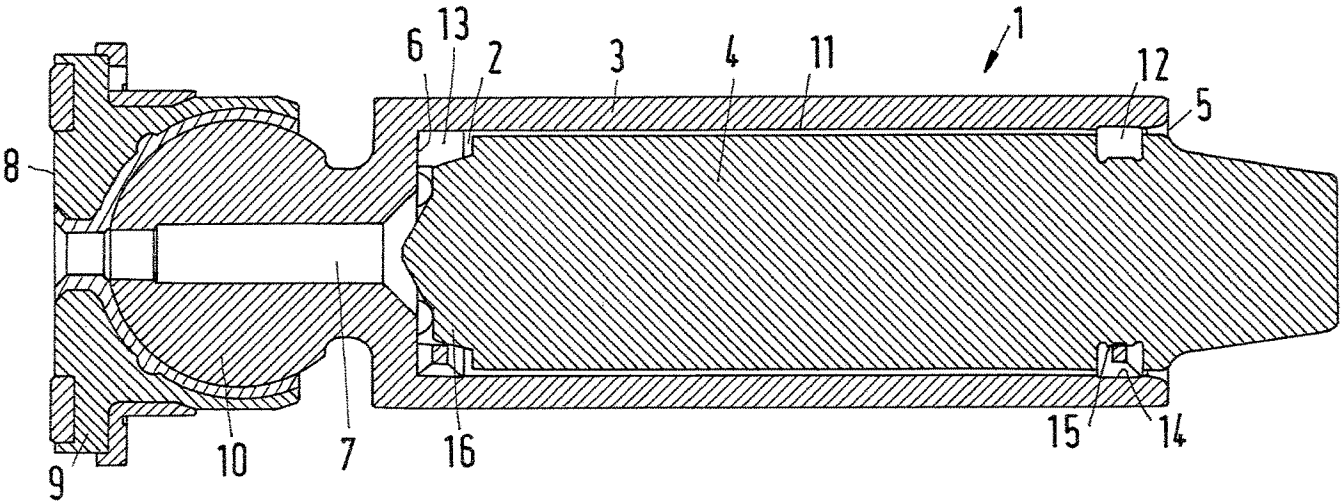
FIG. 1 shows a longitudinal section of a piston according to line A-A of FIG. 2.
Figure 2:
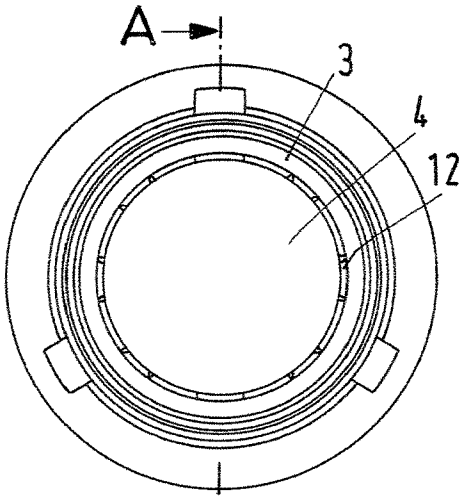
FIG. 2 shows a top view of the piston.

FIG. 1 shows a sectional view of a piston 1 of a hydraulic piston machine. The piston 1 comprises a hollow 2 surrounded by a wall 3. An insert 4 is arranged in the hollow 2.

The insert 4 is made of a ceramic material or another light weight and stiff material which cannot be compressed. Such a material can be a fibre reinforced plastic material, in particular a fibre reinforced polymer, like PEEK (Polyetheretherketone).

The hollow 2 comprises an open end 5 through which the insert 4 can be mounted in the hollow 2. Furthermore, the hollow 2 comprises a bottom 6 at the opposite end. The bottom 6 is basically closed except a channel 7 through which liquid can flow to reach a hydrostatic bearing face 8 of a slider shoe 9. The slider shoe 9 is mounted on a ball 10 of the piston, as it is known in the art. During operation the slider shoe 9 rests against an inclined swash plate and is held against the swash plate by means of a retainer plate (not shown).

A gap 11 is formed between the insert 4 and the wall 3.

The insert 4 is fixed in the hollow 2 by means of a first pliable ring 12 and a second pliable ring 13. The first pliable ring 12 is arranged in an inner groove 14 in the wall 3 and in an outer groove 15 of the insert 4. The inner groove 14 and the outer groove 15 are located adjacent the open end 5 of the hollow 2.

The insert 4 comprises a conical section 16 at or near the end remote from the open end of the hollow 2. The second pliable ring 13 is arranged around the conical section 16 and rests against the bottom 6.

The first pliable ring 12 secures an axial position of the insert 4 in the piston 1 and at the same time secures a radial position of the insert 4 in the hollow 2. The first pliable ring 12 centers the insert 4 with respect to the piston 1 near the open end 5 of the hollow 2.

The second pliable ring 13 secures only a radial position of the insert 4 in the hollow 2. The two pliable rings 12, 13 are arranged with a certain distance to each other along the longitudinal extension of the insert 4. More precisely, they are arranged on both sides of a center of mass of the insert 4. Thus, they prevent a tilting of the insert 4 with respect to the wall 3.

Figure 3:
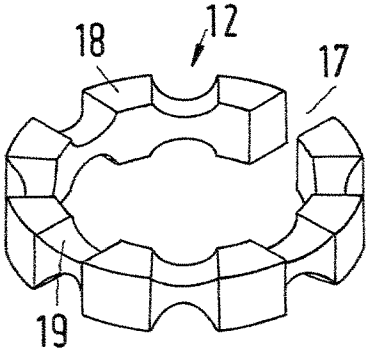
FIG. 3 shows a pliable ring in perspective view.
Figure 4:
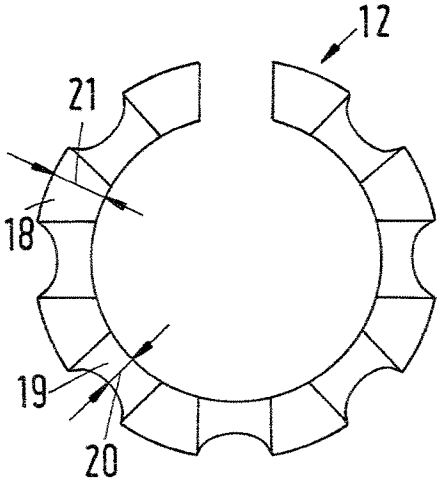
FIG. 4 shows a top view of the ring.
Figure 5:
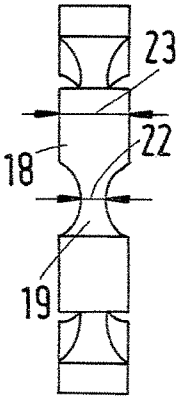
FIG. 5 shows a side view of the ring.

FIGS. 3 to 5 show the first pliable ring 12. In a preferred embodiment of the invention, the second pliable ring 13 has the same form.

The ring 12 is not closed, but open in circumferential direction, i.e. it comprises a clearance 17 in circumferential direction. In an embodiment not shown, the ring 12 can be closed in circumferential direction.

The ring 12 comprises a number of blocks 18 which are evenly distributed in circumferential direction. In other words, the blocks 18 are spaced equidistantly. This is true for the blocks 18 on both sides of the clearance 17.

Two adjacent blocks 18 are connected by means of a thin section 19. The thin section 19 comprises (FIG. 4) a radial extent 20 which is smaller than a radial extent 21 of the blocks 18 which is the largest radial extent of the ring 12.

Furthermore, the thin sections 19 have an axial extension 22 which is smaller than an axial extension 23 of the blocks 18.

Such a construction has the following effect. Due to the smaller radial extent 20 of the thin sections 19 a passage for a fluid is formed through which the fluid can enter the gap 11 between the insert 4 and the wall 3 and can flow past the ring 13 towards to the hydrostatic bearing 8. Furthermore, the thin sections 19 allow for a deformation of the ring 12 which is necessary to mount the insert 4 together with the rings 12, 13 in the hollow 2.

When the insert 4 is mounted by pressing it into the hollow 2, the rings 12, 13 are plastically deformed by an amount which varies slightly depending on the production tolerances of the piston and the insert 4. The first ring 12 flows into the inner groove 14 of the wall 3, so that the axial position of the insert 4 inside the hollow 2 is locked and well defined. The primary function of the second ring 13 is to center the insert 4 inside the piston 1.

The combination of the second pliable ring 13 at the bottom 6 of the hollow 2 and the conical section 16 of the insert 4 ensures good centering of the tip of the insert 4 even if production tolerances for the piston 1 and the insert 4 cause significant variations in the axial clearance between the tip of the insert 4 and the bottom 6 of the hollow 2 in the piston 1.

Thus, the two ends of the insert 4 are locked against radial movements inside the piston 1. Otherwise the inertial forces acting on the insert 4 during operation at high speed can cause the insert 4 to make small movements inside the piston 1 that can eventually lead to wear, formation of damages, and even to the insert 4 getting dislodged over time.

The gap 11 allows a fluid flow which helps to cool the piston 1, so that the piston 1 does not overheat. If the piston 1 overheats, it can get stuck in the cylinder due to excessive thermal expansion of the piston. The first ring 12 (and the second ring 13 likewise) allow fluid to pass in the mounted condition.

The rings 12, 13 furthermore ensure that the insert 4 is accurately centred inside the hollow 2 to ensure uniform size of the gap 11 and uniform fluid flow and cooling in the gap 11. Since the blocks 18 of the rings 12, 13 are placed equidistantly, they ensure even distribution of the fluid flow in the gap 11 and minimize the form defects in the roundness of the piston caused by pressing the insert 4 into the piston.

The piston 1, more precisely the wall 3 of the piston is made of a material with high strength that can withstand the loads on the piston. It is a material with good tribological properties to ensure low frictional losses and low wear of the piston and the components it interfaces with. Finally, the material of the piston must be compatible with the fluid in the piston machine. This will often lead to the piston being made of metal with a high density. The hollow 2 reduces the mass.

The insert 4 reduces the compressibility in the volume in which the piston is moved by filling a significant fraction of the dead volume with a material with higher bulk modules than the fluid but with a lower density than the material of the wall 3 and other parts of the piston 1. The material of the insert 4 must be compatible with the fluid but does not need to have the strength and tribological properties of the material of the rest of the piston 1. The use of the two pliable rings 12, 13 helps to reduce the requirements for the strength of the material of the insert 4 because the gap 11 between the insert 4 and the wall 3 enables the insert 4 to remain straight even if the wall 3 itself is deformed by external loads. This enables the use of materials for the insert 4 with very high stiffness but low strengths, such as for extents light weight ceramics or fibre reinforced polymer, like PEEK (Polyetheretherketone), without risking that bending loads are transferred from the piston to the insert 4.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A piston of a hydraulic piston machine, the piston having a hollow surrounded by a wall and an insert arranged in the hollow, wherein at least two pliable rings are arranged between the insert and the wall, wherein a gap is formed between the insert and the wall, and wherein at least a first ring of the at least two rings comprises at least one thin section having a radial extent smaller than a largest radial extent of the first ring and forming a passage for a fluid.

2. The piston according to claim 1, wherein the first ring is located on one side of a center of mass of the insert and a second ring of the at least two rings is located on another side of the center of mass.

3. The piston according to claim 2, wherein the first ring secures an axial position of the insert in the piston and the second ring secures a radial position of the insert in the hollow only.

4. The piston according to claim 2, wherein the second ring rests against a bottom of the hollow.

5. The piston according to claim 1, wherein the first ring secures an axial position of the insert in the piston and a second ring of the at least two rings secures a radial position of the insert in the hollow only.

6. The piston according to claim 5, wherein the first ring is located adjacent an open end of the hollow.

7. The piston according to claim 6, wherein the first ring is arranged in an inner groove in the wall and in an outer groove in the insert.

8. The piston according to claim 5, wherein the second ring rests against a bottom of the hollow.

9. The piston according to claim 1, wherein one ring of the at least two rings rests against a bottom of the hollow.

10. The piston according to claim 1, wherein the insert comprises a conical section near an end remote from an open end of the hollow and one pliable ring of the at least two rings is arranged around the conical section.

11. The piston according to claim 1, wherein the first ring comprises a number of blocks separated by a thin section of the at least one section.

12. The piston according to claim 11, wherein the blocks are spaced equidistantly.

13. The piston according to claim 11, wherein the thin sections have an axial extension smaller than an axial extension of the blocks.

14. The piston according to claim 1, wherein the at least two pliable rings have the same form.

15. The piston according to claim 1, wherein the insert is of a ceramic material or of fiber reinforced plastics material.

16. A hydraulic piston machine comprising the piston according to claim 1.

* * * * *